US012007218B2

(12) United States Patent
Berthet-Rambaud

(10) Patent No.: US 12,007,218 B2
(45) Date of Patent: Jun. 11, 2024

(54) DEVICE FOR AVALANCHE TRIGGERING SYSTEM AND SYSTEM COMPRISING SUCH A DEVICE, AND A BLASTING CHAMBER

(71) Applicant: BRP, Saint-Sulpice (FR)

(72) Inventor: Philippe Berthet-Rambaud, Saint-Sulpice (FR)

(73) Assignee: BRP, Saint-Sulpice (FR)

( * ) Notice: Subject to any disclaimer, the term of this patent is extended or adjusted under 35 U.S.C. 154(b) by 0 days.

(21) Appl. No.: 18/009,358

(22) PCT Filed: Jun. 11, 2021

(86) PCT No.: PCT/FR2021/051046

§ 371 (c)(1),
(2) Date: Dec. 9, 2022

(87) PCT Pub. No.: WO2021/255370

PCT Pub. Date: Dec. 23, 2021

(65) Prior Publication Data

US 2023/0236000 A1 Jul. 27, 2023

(30) Foreign Application Priority Data

Jun. 15, 2020 (FR) ..... 20/06203

(51) Int. Cl.
*F42D 3/00* (2006.01)

(52) U.S. Cl.
CPC ..... *F42D 3/00* (2013.01)

(58) Field of Classification Search
CPC ..... F42D 3/00
See application file for complete search history.

(56) References Cited

U.S. PATENT DOCUMENTS 8,960,092 B2 2/2015 Farizy
2006/0254449 A1* 11/2006 Hisel ..... F41H 9/04 102/302
2011/0261645 A1* 10/2011 Sager ..... F41H 13/0081 367/14

(Continued)

FOREIGN PATENT DOCUMENTS

FR 2636729 A1 3/1990
FR 2897931 A1 8/2007

OTHER PUBLICATIONS

International Search Report for corresponding application PCT/FR2021/051046 filed Jun. 11, 2021; Report dated Sep. 10, 2021.

*Primary Examiner* — Joshua E Freeman
(74) *Attorney, Agent, or Firm* — CANTOR COLBURN LLP

(57) ABSTRACT

A device for an avalanche triggering system adapted to cooperate with a blasting chamber and including a support frame adapted to be detachably mounted on the blasting chamber, a diffusion chamber, partially delimiting an inner mixing cavity in which is housed a gas mixer configured to produce a gas mixture, the diffusion chamber further having a diffusion opening configured to allow the passage of the gas mixture to the outside of the diffusion chamber, and an ignition system configured to trigger an explosion of the gas mixture, where the diffusion chamber allows placing the device in an operating position configuration in which the device rests, by gravity, on the blasting chamber.

15 Claims, 1 Drawing Sheet

(56) References Cited

U.S. PATENT DOCUMENTS

| | | | | |
|---|---|---|---|---|
| 2012/0318159 | A1* | 12/2012 | Constant | F42D 3/00 102/302 |
| 2013/0133543 | A1* | 5/2013 | Farizy | F42D 3/00 102/302 |
| 2020/0032466 | A1* | 1/2020 | Brophy | F42B 3/22 |
| 2022/0274705 | A1* | 9/2022 | Sly | B64C 39/024 |

* cited by examiner

DEVICE FOR AVALANCHE TRIGGERING SYSTEM AND SYSTEM COMPRISING SUCH A DEVICE, AND A BLASTING CHAMBER

TECHNICAL FIELD

The present disclosure concerns firstly a device for an avalanche triggering system, in particular snow avalanches.

The disclosure also relates to an avalanche triggering system as such, in particular snow avalanches, comprising such a device.

BACKGROUND

It is known to use avalanche triggering devices in areas where the accumulation of snow could generate avalanches threatening places or people.

In order to cause an avalanche, it is generally expected to generate a shock wave from an explosion. Since the movement and handling of explosives is dangerous and regulated, it is preferable to use a mixture of explosive gases to generate the shock wave. Furthermore, in order to guarantee better operator safety, it is known to use remotely controlled systems. These systems must have the same performance as other devices in terms of potentially influenced area of the snowpack. In addition, some additional characteristics are sought such as reduced footprint, the integration into the landscape and the removability by helicopter. This last characteristic is particularly important because it allows to remove said devices in summer, when their use is unnecessary to limit their exposure to lightning and to falling rocks, but also to carry out maintenance and repair operations by limiting exposure of operators to difficult high mountain conditions.

Prior art solutions suggest removable remote avalanche triggering devices based on the explosion of a hydrogen/oxygen gas mixture inside an open cone. The document FR2958739A1 presents in particular a solution according to which a module comprising the blasting chamber is placed on a fixed support leg positioned in avalanche starting areas. This solution is satisfactory in that it makes it possible to have a removable device capable of triggering avalanches when it is remotely controlled.

However, the performance of avalanche triggering devices depends on the quantity and the type of gases used for the explosive gas mixture, but also on the size and the volume of the enclosure used to produce the explosion. It therefore appears that it is preferable to use a large volume enclosure with a large quantity of gas to maximize the explosion, because it is within the enclosure that the effects of the explosion will develop from ignition of this quantity of gas.

Thus, the search for better performance may quickly find compatibility limits, in particular with the mass capacities adapted to be transported by helicopter for the removability criterion previously mentioned. For an integrated system with a constant mass that may be transported by helicopter, it is therefore necessary to find an optimum for distributing this removable mass between the various constituent elements of the device, such as the enclosure, the gas reserves, the various equipment and control equipment. This optimum is also limiting and does not allow the power to be increased indefinitely because it requires to increase the mass.

BRIEF SUMMARY

The present disclosure aims at suggesting a solution which responds to all or part of the aforementioned problems:

This aim may be achieved thanks to the implementation of a device for an avalanche triggering system, said device being adapted to cooperate with a blasting chamber of the avalanche triggering system.

The device comprises:

- a support frame carrying at least one gas storage system and adapted to be detachably mounted on the blasting chamber so as to cover all or part of the blasting chamber;
- a diffusion chamber secured to the support frame by means of a fixed proximal end of the diffusion chamber, all or part of an inner mixing cavity being delimited by at least one portion of the diffusion chamber, a gas mixer in fluid communication with said at least one gas storage system being housed in the inner mixing cavity, said gas mixer being configured to produce a gas mixture from the gases coming from said at least one gas storage system, the diffusion chamber further comprising at least one diffusion opening configured to allow the passage of the gas mixture from the inner mixing cavity to the outside of the diffusion chamber, in particular to supply the blasting chamber; and
- at least one ignition system configured to trigger an explosion of the gas mixture.

The diffusion chamber comprises a body extending from the fixed proximal end to a free distal end, said body being adapted to be contained in a volume of the blasting chamber when the device rests, by gravity, on the blasting chamber, in an operating position configuration.

The arrangements previously described make it possible to suggest a device capable both of storing and mixing the gases necessary for the explosion, of injecting the mixture of gases into the blasting chamber, and of igniting the gas mixture previously injected into the blasting chamber. Furthermore, the diffusion chamber advantageously makes it possible to interface in a simple manner with the blasting chamber without requiring any particular manoeuvre. In other words, the device is adapted to occupy the operating position configuration by simply pressing on the blasting chamber.

In addition, the position of the device on the blasting chamber ensures the closing of the blasting chamber at the place where the device rests.

The device may additionally have one or several features of the following features, taken alone or in combination.

According to one embodiment, the body is adapted to be at least partially inserted into a receiving opening delimited by the blasting chamber to place the device in the operating position configuration where the proximal and distal ends of the diffusion chamber are positioned on either side of the receiving opening.

According to one embodiment, the at least one ignition system is disposed on a surface of the diffusion chamber, and in particular on an outer surface of the diffusion chamber.

According to one embodiment, the support frame comprises at least two lateral support elements arranged so as to extend on either side of the blasting chamber when the device occupies the operating position configuration. In particular, the lateral support elements may comprise stiffened walls, profiles, branches or beams.

Advantageously, the support elements may be configured so that the device has a centre-of-gravity disposed lower than the receiving opening formed in the blasting chamber. Thus, and synergistically, the device may act as a counterweight, helping to oppose upward displacements due to the ejection of the shock wave from the blasting chamber.

According to one embodiment, the support frame has a central portion on which the diffusion chamber is fastened, the support elements extending from the central portion on either side of the latter, allowing in particular that the support elements extend along the sides of the blasting chamber when the device is in the operating position configuration.

According to one embodiment, the support frame comprises positioning means, for example rollers disposed at each of the support elements, so as to allow the possibility of modifying the orientation of the device with respect to the blasting chamber when the device occupies the operating position configuration, and to facilitate the return of said device to the operating position configuration after an explosion.

According to one embodiment, the diffusion chamber comprises an interlocking flange intended to cooperate with the periphery of the receiving opening formed in the blasting chamber.

According to one embodiment, the interlocking flange has the shape of a crown or a cylinder.

According to one embodiment, the interlocking flange comprises a damping seal, said damping seal being disposed on a surface of the interlocking flange intended to cooperate with the periphery of the receiving opening. In this way, the damping seal makes it possible to guarantee a gas tightness between the exterior of the blasting chamber and the interior of the blasting chamber at the receiving opening when the device occupies the operating position configuration.

According to one embodiment, the body of the diffusion chamber has a section decreasing from the fixed proximal end towards the free distal end.

According to one embodiment, the shape of the diffusion chamber is comprised in a truncated cone.

According to one embodiment, the free distal end has a pointed shape.

According to one embodiment, the diffusion chamber has a height, counted between the fixed proximal end and the free distal end of the diffusion chamber, greater than a diameter of the receiving opening of the blasting chamber with which the device cooperates.

According to one embodiment, the receiving opening is circular. In this case, the height of the diffusion chamber may be greater than the diameter of said circular opening.

According to one embodiment, said at least one diffusion opening is formed in the body of the diffusion chamber on an area close to the free distal end. By "close to the free end", it should be understood an area comprised at a distance less than half the height of the diffusion chamber.

According to one embodiment, said at least one gas storage system comprises a fuel bottle and an oxidizer bottle, the gas mixer being connected to said fuel bottle by a fuel line and to the oxidizer bottle by an oxidizer line.

According to one embodiment, the fuel line and the oxidizer line are each equipped, between the gas storage system and the gas mixer, with a check valve, a pressure reducer and at least one valve configured to allow the passage of a gas from the concerned gas storage system to the gas mixer, and alternatively to prevent the passage of a gas, or a flame from the gas mixer to the gas storage system.

According to one embodiment, the device comprises a monitoring member comprising a communication element configured to exchange instructions with an external control unit, the monitoring member being configured to monitor the at least one ignition system.

According to one embodiment, the control member comprises at least one physical sensor configured to measure at least one physical parameter, for example a thermometer, an accelerometer, a seismometer, or an anemometer.

According to one embodiment, the monitoring member comprises an electrical power generation device configured to supply electric power to the device.

According to one embodiment, the monitoring member comprises an electric power storage element configured to store electric power, and to supply electric power to the device.

The arrangements previously described make it possible to propose a device that is energetically autonomous.

According to one embodiment, the electrical power generation member may comprise an element selected from the group consisting of a wind turbine, solar panels, a fuel cell.

According to one embodiment, the support frame comprises a gripping element configured to allow the device to be moved integrally by traction, and in particular by lifting and/or towing.

According to one embodiment, the gripping element comprises a ring or a hook intended to be lifted by a transport device, for example a helicopter.

The disclosure also provides the implementation of an avalanche triggering system comprising a device of the type of one of those previously described, and a blasting chamber having an open end oriented towards a snowpack.

The arrangements previously described make it possible to suggest an avalanche triggering system composed of at least two independent and completely removable portions, that is to say on the one hand the blasting chamber and on the other hand the device. Thus, it is possible to install independently and simply the blasting chamber and the device in areas preferably accessible by helicopter, for example by two independent leads.

The avalanche triggering system may additionally have one or more of the following features, taken alone or in combination.

According to one embodiment, the body of the diffusion chamber is at least partially inserted into the receiving opening delimited by the blasting chamber so that the device is in the operating position configuration where the proximal and distal ends of the body of the diffusion chamber are positioned on either side of the receiving opening, the device resting on the blasting chamber by simple gravity.

In this way, the device may simply lift in relation to the blasting chamber, in particular under the effect of the explosion of the explosive gas mixture.

According to one embodiment, the device is adapted to be moved by rotation or translation relative to the blasting chamber when the avalanche triggering system occupies the operating position configuration.

According to one embodiment, the support frame and the blasting chamber delimit an explosion cavity in which the diffusion chamber is entirely comprised.

According to one embodiment, the blasting chamber has a tubular shape comprising at least one first curved enclosure portion having an extrados facing the snowpack and one second curved enclosure portion having an intrados facing the snowpack.

According to one embodiment, the blasting chamber comprises an enclosure support, in particular at the first enclosure portion of the blasting chamber, said enclosure support being intended to rest on the ground or be fixed on a base element.

According to one embodiment, the device is configured to be mounted on the blasting chamber at the first enclosure portion of the blasting chamber in the operating position configuration.

In other words, the first enclosure portion has a curved shape with a concavity facing the snowpack, and the second enclosure portion has a curved shape with an inverted concavity with respect to the first enclosure portion.

According to one embodiment, the blasting chamber comprises a closed end opposite the open end, the blasting chamber comprising a fastening member at said closed end, said fastening member being configured to cooperate with an outer retention system.

For example, the outer retention system may comprise a guide channel having a shape into which the fastening member may be slidably inserted so as to maintain the blasting chamber in a fastening configuration. Said fastening configuration makes it possible to maintain the device in a position blocking the degrees of freedom requested during the explosion of the gas mixture.

BRIEF DESCRIPTION OF THE DRAWINGS

Other aspects, objects, advantages and features of the disclosure will appear better upon reading the following detailed description of preferred embodiments thereof, given by way of non-limiting example, and made with reference to the appended drawings on which.

DETAILED DESCRIPTION

In the figures and in the remainder of the description, the same references represent identical or similar elements. In addition, the different elements are not represented to scale so as to focus on clarity of the figures.

Furthermore, the different embodiments and variants are not mutually exclusive and may be combined with each other.

Figure 1:
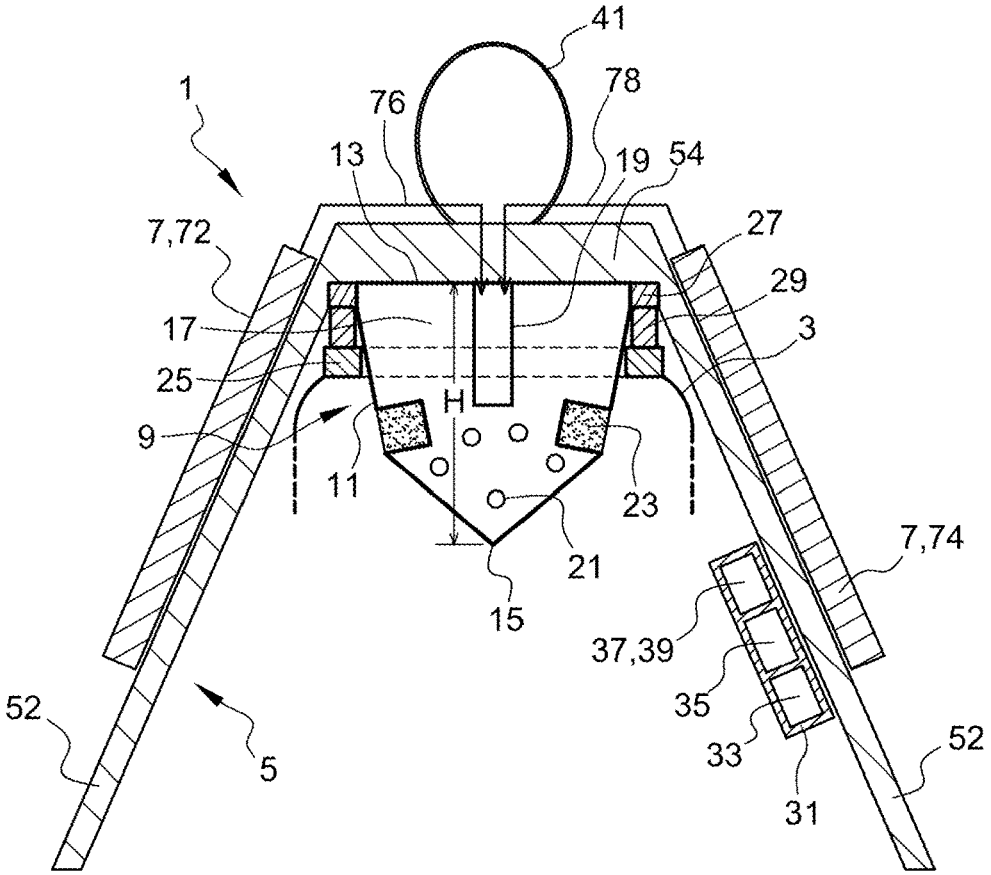
FIG. 1 is a schematic view of a device according to an embodiment of the disclosure, when it rests on a blasting chamber in the operating position configuration.

As illustrated in FIG. 1, the disclosure concerns a device 1 for an avalanche triggering system denoted "S", said device 1 being adapted to cooperate with a blasting chamber 3 of the avalanche triggering system S.

The device 1 comprises in particular a support frame 5 adapted to be detachably mounted on the blasting chamber 3 so as to cover all or part of the blasting chamber 3. For this purpose, the support frame 5 may comprise a frame central portion 54, and two lateral support elements 52 extending from the frame central portion 54 on either side of the latter, allowing in particular that the lateral support elements 52 extend along the sides of the blasting chamber 3. The device 1 may then occupy an operating position configuration with the blasting chamber 3. In other words, the lateral support elements 52 are both arranged so as to extend on either side of the blasting chamber 3 when the device 1 occupies the operating position configuration.

According to an embodiment not represented, the support frame 5 may also comprise positioning means, such as rollers disposed at each of the lateral support elements 52, so as to make it possible to modify the orientation of the device 1 with respect to the blasting chamber 3 when the device 1 occupies the operating position configuration.

The support frame also carries at least one gas storage system 7 comprising for example a fuel bottle 72 and an oxidizer bottle 74.

The device 1 may comprise a monitoring member 31 comprising a communication element 33 configured to exchange instructions with an external control unit. Said monitoring member 31 may advantageously be carried by the support frame 5. The monitoring member 31 may comprise at least one physical sensor 35 configured to measure at least one physical parameter, for example a thermometer, an accelerometer, a seismometer, or an anemometer. The monitoring member 31 may also comprise an electrical power generation member 37 configured to supply electric power to the device 1, and an electric power storage element 39 configured to store said electrical power. For example, the electrical power generation member 37 may be a wind turbine, or solar panels, or a fuel cell.

Alternatively, the device 1 may comprise an electric power storage element 39 configured to store electric power and to supply electric power to the device 1.

FIG. 1 illustrates an embodiment in which the device comprises two gas storage systems 7 disposed on each of the support elements 52, and a monitoring member 31 comprising a communication element 33, a physical sensor 35, an electrical power generation member 37 and an electric power storage element 39. It is also possible that each of the electrical power generation member 37 and the electric power storage element 39 is carried by a different support element 52. Advantageously, the gas storage system 7, the monitoring member 31, the communication element 33, the physical sensor 35, the electrical power generation member 37 and the electric power storage element 39 may be distributed over the support elements 52, so as to balance the total mass of the support frame 5.

Advantageously, the support frame 5 may comprise a gripping element 41 configured to allow the device 1 to be moved integrally by traction, and in particular by lifting or towing. FIG. 1 illustrates a non-limiting variant for which the gripping element 41 comprises a ring or a hook intended to be lifted by a transport device, for example a helicopter.

The device also comprises a diffusion chamber 9 secured to the support frame 5 by a fixed proximal end 13 of the diffusion chamber 9. For example, the fixed proximal end 13 of the diffusion chamber 9 may be fastened to the support frame 5 at the frame central portion 54. The diffusion chamber 9 comprises a body 11 extending from the fixed proximal end 13 to a free distal end 15 having for example a sharp shape. The body 11 of the diffusion chamber 9 may in particular have a decreasing section from the fixed proximal end 13 towards the free distal end 15. According to a non-limiting variant, the shape of the diffusion chamber 9 may therefore be comprised in a truncated cone. Thus the body 11 may be adapted to be at least partially inserted into a receiving opening 25 delimited by the blasting chamber 3 to place the device 1 in the operating position configuration. In this case, the proximal 13 and distal 15 ends of the diffusion chamber 9 are positioned on either side of the receiving opening 25, in particular allowing the device 1 to rest, by gravity, on the blasting chamber 3. All or part of an inner mixing cavity 17 is then delimited by at least one portion of the diffusion chamber 9.

The diffusion chamber 9 may comprise an interlocking flange 27 intended to cooperate with the periphery of the receiving opening 25 formed in the blasting chamber 3. For example, the interlocking flange 27 may have the shape of a crown, or a cylinder. Advantageously, the interlocking flange 27 may comprise a damping seal 29 disposed on a surface of the interlocking flange 27 intended to cooperate with the periphery of the receiving opening 25. In this way, the damping seal 29 makes it possible to guarantee gas-tightness between the exterior of the blasting chamber 3 and the interior of the blasting chamber 3 at the receiving opening 25 when the device 1 occupies the operating position configuration.

The diffusion chamber 9 may have a height denoted "H", counted between the fixed proximal end 13 and the free distal end 15 of the diffusion chamber 9, greater than a diameter of the receiving opening 25 of the blasting chamber 3 with which the device 1 cooperates. Thus, in the case where the receiving opening 25 is circular, the height H of the diffusion chamber 9 may be greater than the diameter of said circular opening.

The diffusion chamber 9 also comprises a gas mixer 19 in fluid communication with said at least one gas storage system 7. The gas mixer 19 is housed in the inner mixing cavity 17, and configured to produce a gas mixture from the gases coming from the gas storage system(s) 7. For example, the gas storage system 7 may comprise a fuel bottle 72 and an oxidizer bottle 74. The gas mixer 19 is then connected to the bottle 72 by a fuel line 76 and to the oxidizer bottle 74 by an oxidizer line 78. In this case, the gas mixer 19 is adapted to produce a gas mixture from the oxidizer gas and the fuel gas according to predetermined proportions. Advantageously, the fuel line 76 and the oxidizer line 78 may each be equipped, between the gas storage system 7 and the gas mixer 19, with a check valve, a pressure reducer, and at least one valve configured to allow the passage of a gas from the concerned gas storage system 7 to the gas mixer 19, and alternatively to prevent the passage of a gas or a flame from the gas mixer 19 to the gas storage system 7.

The diffusion chamber 9 further comprises at least one diffusion opening 21 configured to allow the passage of the gas mixture from the inner mixing cavity 17 to the outside of the diffusion chamber 9, in particular to supply the blasting chamber 3. FIG. 1 illustrates in particular an embodiment in which the diffusion chamber 9 comprises a plurality of diffusion openings 21. For example, the diffusion opening or openings 21 may be formed in the body 11 of the diffusion chamber 9 on an area close to the free distal end 15. By "close to the free end" it should be understood an area comprised at a distance less than half the height H of the diffusion chamber 9.

Finally, the device 1 comprises at least one ignition system 23 for example disposed on an outer surface of the diffusion chamber 9, and configured to trigger an explosion of the gas mixture. The ignition of the ignition system 23 may in particular be monitored by the monitoring member 31, and particularly according to instructions communicated by the communication element 33 and/or measurements carried out by the physical sensor(s) 35.

The previously described arrangements make it possible to suggest an device 1 capable both of storing and mixing the gases necessary for explosion, of injecting the gas mixture into the blasting chamber 3, and of igniting the gas mixture previously injected into the blasting chamber 3. Furthermore, the diffusion chamber 9 advantageously makes it possible to interface in a simple manner with the blasting chamber 3 without requiring any particular operation.

Furthermore, the position of the device 1 on the blasting chamber 3 makes it possible to ensure the closing of the blasting chamber 3 at the place where the device 1 rests, in particular at the receiving opening 25.

Advantageously, the lateral support elements 52 may be configured so that the device 1 has a centre-of-gravity disposed lower than the receiving opening 25 formed in the blasting chamber 3. Thus, and synergistically, the device 1 may act as a counterweight, by helping to oppose the upward displacements due to the ejection of the shock wave from the blasting chamber 3.

Finally, the previously described arrangements make it possible to suggest an device 1 that is energetically autonomous.

Figure 2:
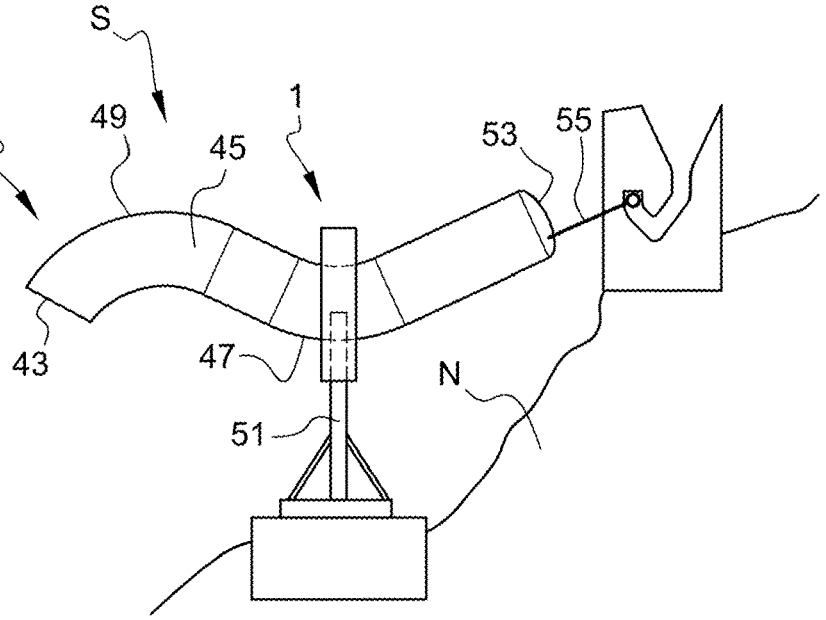
FIG. 2 is a schematic view of the avalanche triggering system according to an embodiment of the disclosure

With reference to FIG. 2, the disclosure also concerns the avalanche triggering system S comprising an device 1 of the type of one of those previously described and an blasting chamber 3.

The blasting chamber 3 may have a tubular shape comprising at least one first curved enclosure portion 47 having an extrados facing a snowpack denoted "N", and one second curved enclosure portion 49 having an intrados facing the snowpack N. The blasting chamber 3 comprises an open end 43 oriented towards the snowpack N, and a closed end 53 opposite the open end 43. A fastening member 55 may be disposed at said closed end 53, so as to cooperate with an outer retention system. For example, the outer retention system may comprise a guide channel having a shape in which the fastening member 55 may be inserted slidably so as to maintain the blasting chamber 3 in a fastening configuration. The fastening configuration therefore makes it possible to maintain the device 1 in a position blocking the degrees of freedom requested during the explosion of the gas mixture. Furthermore, the blasting chamber 3 may comprise an enclosure support 51 resting on the ground or being fastened to a base element, in particular at the first enclosure portion 47 of the blasting chamber 3.

According to the non-limiting variant represented in FIG. 2, the device 1 may be configured to be mounted on the blasting chamber 3 at the first enclosure portion 47 of the blasting chamber 3 in the operating position configuration. Advantageously, the body 11 of the diffusion chamber 9 may be at least partially inserted into the receiving opening 25 delimited by the blasting chamber 3. In this way, the device 1 is in the operating position configuration, the proximal and distal ends of the body 11 of the diffusion chamber 9 being positioned on either side of the receiving opening 25, the device 1 resting, by simple gravity, on the blasting chamber 3. Thus, the device 1 may be moved by rotation or translation relative to the blasting chamber 3. Thus, the device 1 may simply be lifted relative to the blasting chamber 3, in particular during the explosion of explosive gas mixture.

According to a non-limiting embodiment, the support frame 5 and the blasting chamber 3 may delimit an explosion cavity 45 in which the diffusion chamber 9 is entirely comprised.

The arrangements previously described make it possible to suggest an avalanche triggering system S composed of at least two independent and completely removable portions, that is to say on the one hand the blasting chamber 3 and on the other hand the device 1. Thus, it is possible to install independently and simply the blasting chamber 3 and the device 1 in areas preferably accessible by helicopter, for example by two independent leads.

The invention claimed is:

1. A device for an avalanche triggering system, said device being adapted to cooperate with a blasting chamber of the avalanche triggering system, said device comprising:

a support frame carrying at least one gas storage system and adapted to be detachably mounted on the blasting chamber so as to cover all or part of the blasting chamber;

a diffusion chamber secured to the support frame by means of a fixed proximal end of the diffusion chamber, all or part of an inner mixing cavity being delimited by at least one portion of the diffusion chamber, a gas mixer in fluid communication with said at least one gas storage system being housed in the inner mixing cavity, said gas mixer being configured to produce a gas mixture from the gas coming from said at least one gas storage system, the diffusion chamber further comprising at least one diffusion opening configured to allow the passage of the gas mixture from the inner mixing cavity to the outside of the diffusion chamber, in particular to supply the blasting chamber;

at least one ignition system configured to trigger an explosion of the gas mixture;

the diffusion chamber comprising a body extending from the fixed proximal end to a free distal end, said body being adapted to be contained in a volume of the blasting chamber when the device rests, by gravity, on the blasting chamber in an operating position configuration.

2. The device according to claim 1, wherein the body is adapted to be at least partially inserted into a receiving opening delimited by the blasting chamber to place the device in the operating position configuration where the proximal and distal ends of the diffusion chamber are positioned on either side of the receiving opening.

3. The device according to claim 2, wherein the diffusion chamber comprises an interlocking flange intended to cooperate with the periphery of the receiving opening formed in the blasting chamber.

4. The device according to claim 1, wherein the support frame comprises at least two lateral support elements arranged so as to extend on either side of the blasting chamber when the device occupies the operating position configuration.

5. The device according to claim 1, wherein said at least one gas storage system comprises a fuel bottle and an oxidizer bottle, the gas mixer being connected to said fuel bottle by a fuel line and to the oxidizer bottle by an oxidizer line.

6. The device according to claim 1, comprising a monitoring member comprising an electrical power generation member configured to supply electric power to the device, and/or an electric power storage element configured to store said electric power, and a communication element configured to exchange instructions with an external control unit, the monitoring member being configured to monitor the at least one ignition system.

7. The device according to claim 6, wherein the monitoring member comprises at least one physical sensor configured to measure at least one physical parameter, for example a thermometer, an accelerometer, a seismometer, or an anemometer.

8. The device according to claim 1, wherein the support frame comprises a gripping element configured to allow the device to be displaced integrally by lifting or towing.

9. An avalanche triggering system comprising a device according to claim 1, and a blasting chamber having an open end oriented towards a snowpack.

10. The avalanche triggering system according to claim 9, wherein the device is adapted to be displaced by rotation or translation relative to the blasting chamber when the avalanche triggering system occupies the operating position configuration.

11. The avalanche triggering system according to claim 9, wherein the support frame and the blasting chamber delimit an explosion cavity in which the diffusion chamber is entirely comprised.

12. The avalanche triggering system according to claim 9, wherein the blasting chamber has a tubular shape comprising at least one first curved enclosure portion having an extrados facing the snowpack and a second curved enclosure portion having an intrados facing the snowpack.

13. The avalanche triggering system according to claim 12, wherein the blasting chamber comprises an enclosure support, in particular at the first enclosure portion of the blasting chamber, said enclosure support being intended to rest on the ground or to be fastened to a base element.

14. The avalanche triggering system according to claim 12, wherein the device is configured to be mounted on the blasting chamber at the first enclosure portion of the blasting chamber in the operating position configuration.

15. The avalanche triggering system according to claim 12, wherein the tubular-shaped blasting chamber comprises a closed end opposite the open end, the blasting chamber comprising a fastening member at said closed end, said fastening member being configured to cooperate with an outer retention system.

* * * * *